US007331622B2

(12) United States Patent
Sewell

(10) Patent No.: US 7,331,622 B2
(45) Date of Patent: Feb. 19, 2008

(54) OIL CONTAINER CARRIER

(75) Inventor: James H. Sewell, Concord, NC (US)

(73) Assignee: Roberts Polypro, Inc., Charlotte, NC (US)

( * ) Notice: Subject to any disclaimer, the term of this patent is extended or adjusted under 35 U.S.C. 154(b) by 1 day.

(21) Appl. No.: 11/067,971

(22) Filed: Feb. 28, 2005

(65) Prior Publication Data

US 2006/0192401 A1 Aug. 31, 2006

(51) Int. Cl.
*A45F 5/10* (2006.01)

(52) U.S. Cl. ..... 294/159; 294/87.2; 220/759

(58) Field of Classification Search ..... 294/159, 294/87.2, 137, 170, 15, 143, 146; 206/150, 206/198; 220/752–776, 737
See application file for complete search history.

(56) References Cited

U.S. PATENT DOCUMENTS 1,498,247 A * 6/1924 Stewart ..... 294/146
2,028,026 A * 1/1936 Storch ..... 211/26
3,269,530 A 8/1966 Wanderer
3,830,361 A 8/1974 Klygis
4,109,787 A 8/1978 Klygis et al.
4,247,142 A 1/1981 Erickson
4,448,452 A 5/1984 Wood
4,487,312 A 12/1984 Heider
4,681,004 A 7/1987 Waldner
D294,559 S * 3/1988 Schwalbach ..... D9/434
4,811,861 A 3/1989 Roberts
4,822,656 A 4/1989 Hutter, III
D307,712 S * 5/1990 Ralls et al. ..... D9/752
4,946,536 A 8/1990 Roberts
5,052,992 A 10/1991 Hyder
5,306,060 A 4/1994 Borg
5,447,259 A * 9/1995 Erickson ..... 220/759
5,467,915 A 11/1995 Mattson
5,507,544 A * 4/1996 McQuade et al. ..... 294/159
RE35,288 E 7/1996 Borg
5,624,012 A 4/1997 Wang
5,695,232 A * 12/1997 Tipp ..... 294/87.2
5,735,562 A 4/1998 Borg
5,736,217 A 4/1998 Banfield et al.
5,782,325 A 7/1998 O'Shea et al.
5,882,057 A * 3/1999 Fahy ..... 294/159
6,027,773 A 2/2000 Sterr et al.
6,047,798 A 4/2000 Lin
6,070,888 A 6/2000 Wang
6,129,397 A 10/2000 Borg
6,152,508 A * 11/2000 Slomski ..... 294/87.2

(Continued)

*Primary Examiner*—Saul Rodriguez
*Assistant Examiner*—Paul T Chin
(74) *Attorney, Agent, or Firm*—Thompson Hine LLP

(57) ABSTRACT

A carrier is provided for use with containers including handles. The container carrier comprises a flexible platform having a perimeter, a longitudinal axis, and an opening, with a portion of the platform at least partially defining the opening and adjacent the closest side of the perimeter of the platform so as to form a handle including a strap. The strap is located such that the longitudinal axis of the platform transverses the strap. Recessed portions are located in the perimeter of the platform, and the recessed portions are located on opposite sides of the longitudinal axis of the platform that transverses the strap. Each recess portion receives a container handle of the adjacent containers. The opening is sized so as to receive at least one of a user's fingers for lifting and transporting the containers.

21 Claims, 8 Drawing Sheets

U.S. PATENT DOCUMENTS

| | | | | |
|---|---|---|---|---|
| 6,179,101 | B1 | 1/2001 | Lin | |
| 6,196,366 | B1 | 3/2001 | Lin | |
| 6,378,764 | B1 | 4/2002 | Teixidor Casanovas | |
| 6,409,871 | B1 | 6/2002 | Washburn et al. | |
| 6,418,606 | B1 | 7/2002 | Bachand | |
| 6,499,781 | B1 * | 12/2002 | Flynn | 294/159 |
| 6,511,114 | B1 * | 1/2003 | Fludd | 294/159 |
| 6,536,820 | B1 * | 3/2003 | Dean et al. | 294/159 |
| 6,779,655 | B2 * | 8/2004 | Olsen et al. | 206/150 |

* cited by examiner

OIL CONTAINER CARRIER

BACKGROUND

This invention relates to a container carrier, and more particularly to a container carrier for carrying containers by their handles.

Containers can often weigh a substantial amount, depending upon the contents, and volume, of the container. For example, a filled one gallon container of anti-freeze weighs approximately 10 pounds. When consumers purchase such containers, they generally must use a handle to carry the container. Often times, this handle is integral with the container. Alternatively, a separate container carrier is secured to the container.

Carriers which enable containers to be carried by their handles are well known. However, conventional carriers suffer from a number of deficiencies. For example, some container carriers are quite elaborate and necessarily therefore are difficult to manufacture or cumbersome to ship and store. Further, container carriers can be uncomfortable to use because the handle of the container carrier bites into the fingers of the user when the user lifts and transports the containers with the container carrier.

Containers having molded handles that are integral with the container, such as one gallon-sized oil or anti-freeze containers, milk jugs and the like, have presented particularly troublesome problems for accommodating container carriers. In particular, given the significant weights of such filled containers, the container carrier needs to be adequately secured on the containers and be of sufficient tensile strength to allow the containers to be carried comfortably, easily and securely.

For the foregoing reasons, there is a need for a container carrier that securely attaches to the container to be transported, and that is easy and comfortable to use. The new container carrier should be durable and resistant to tearing and ripping while under the weight and stress of heavy containers. Ideally, the design of the container carrier is one that can be efficiently and inexpensively manufactured and that allows for simple, straightforward application onto containers.

SUMMARY

According to the present invention, a carrier is provided for use with containers including handles. The container carrier comprises a flexible platform having a perimeter, a longitudinal axis, and an opening, with a portion of the platform at least partially defining the opening and adjacent the closest side of the perimeter of the platform so as to form a handle including a strap. The strap is located such that the longitudinal axis of the platform transverses the strap. Recessed portions are located in the perimeter of the platform, and the recessed portions are located on opposite sides of the longitudinal axis of the platform that transverses the strap. Each recess portion receives a container handle of the adjacent containers. The opening is sized so as to receive at least one of a user's fingers for lifting and transporting the containers.

Also according to the present invention, an apparatus is provided for a carrier comprising a flexible platform having a perimeter, container engaging portions in the perimeter, a longitudinal axis, and an opening, with a portion of the platform at least partially defining the opening and adjacent the closest side of the perimeter of the platform forming a handle with a strap. The strap is located such that the longitudinal axis of the platform transverses the strap, and the handle and the inner region of the platform define an opening for allowing at least one of a user's fingers to wrap around the handle. The carrier apparatus comprises at least one flange adapted to be integral with the handle, so that, during transport of containers, at least one of the user's fingers engages the handle and the flange, thus enabling the handle and flange to provide a surface for the user's fingers.

Further according to the present invention, a carrier is provided for use with containers including handles. The container carrier comprises a flexible platform having a perimeter and a longitudinal axis. The container carrier comprises (a) a handle including a strap, and is adapted and placed such that the strap is bisected by the longitudinal axis of the platform; and (b) container engaging portions that are adapted to be integral within the perimeter of the platform such that an opening is defined for receiving the handles of the containers, with the container engaging portions located such that they are on opposite sides of the longitudinal axis of the platform. The handle is adapted and located within the platform so as to partially define an opening for receiving at least one of a user's fingers for lifting and transporting the containers.

DRAWINGS

For a more complete understanding of the present invention, reference should now be had to the embodiments shown in the accompanying drawings and described below. In the drawings.

DESCRIPTION

Figure 1:
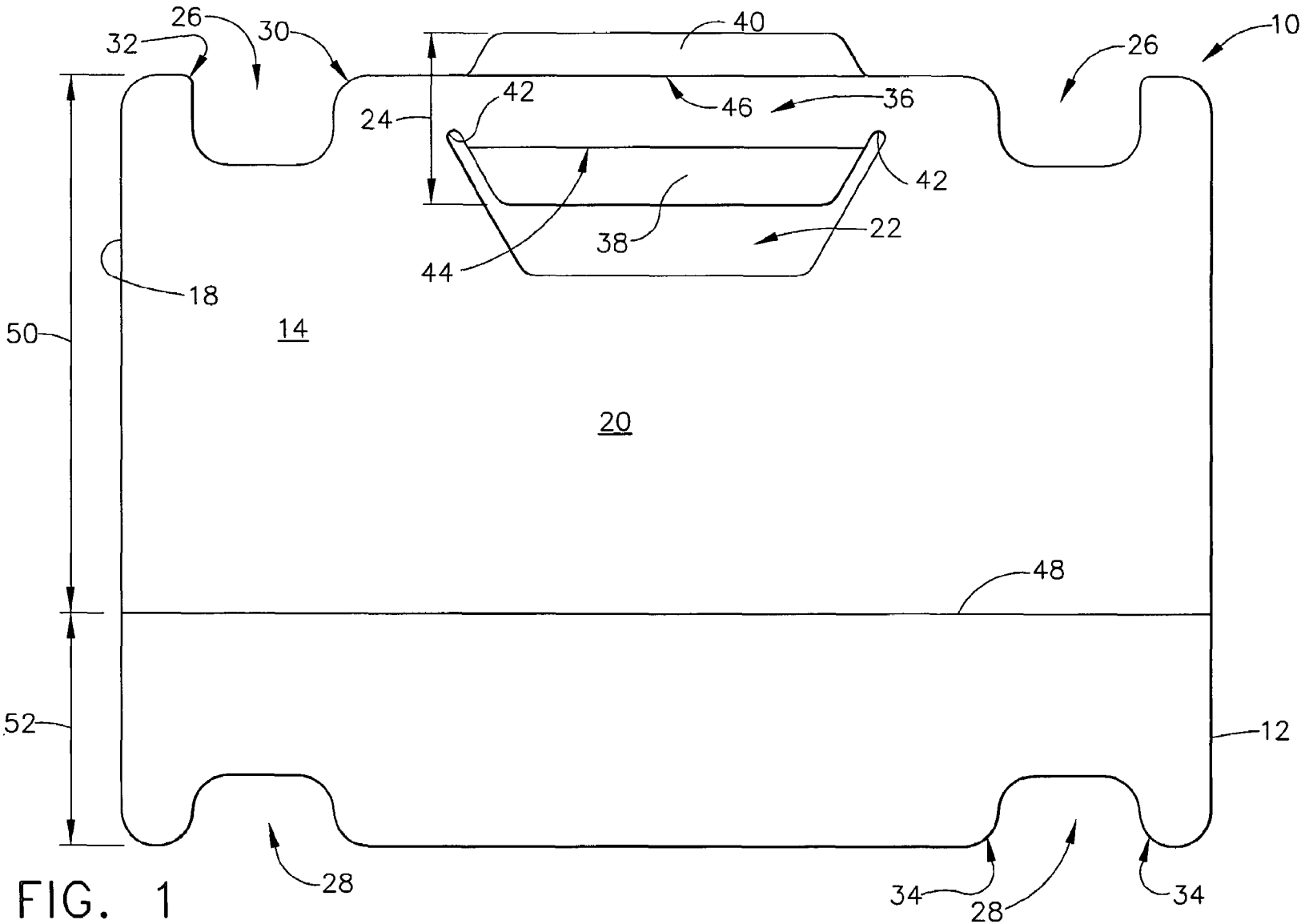
FIG. 1 is a top plan view of an embodiment of a container carrier according to the present invention.
Figure 2:
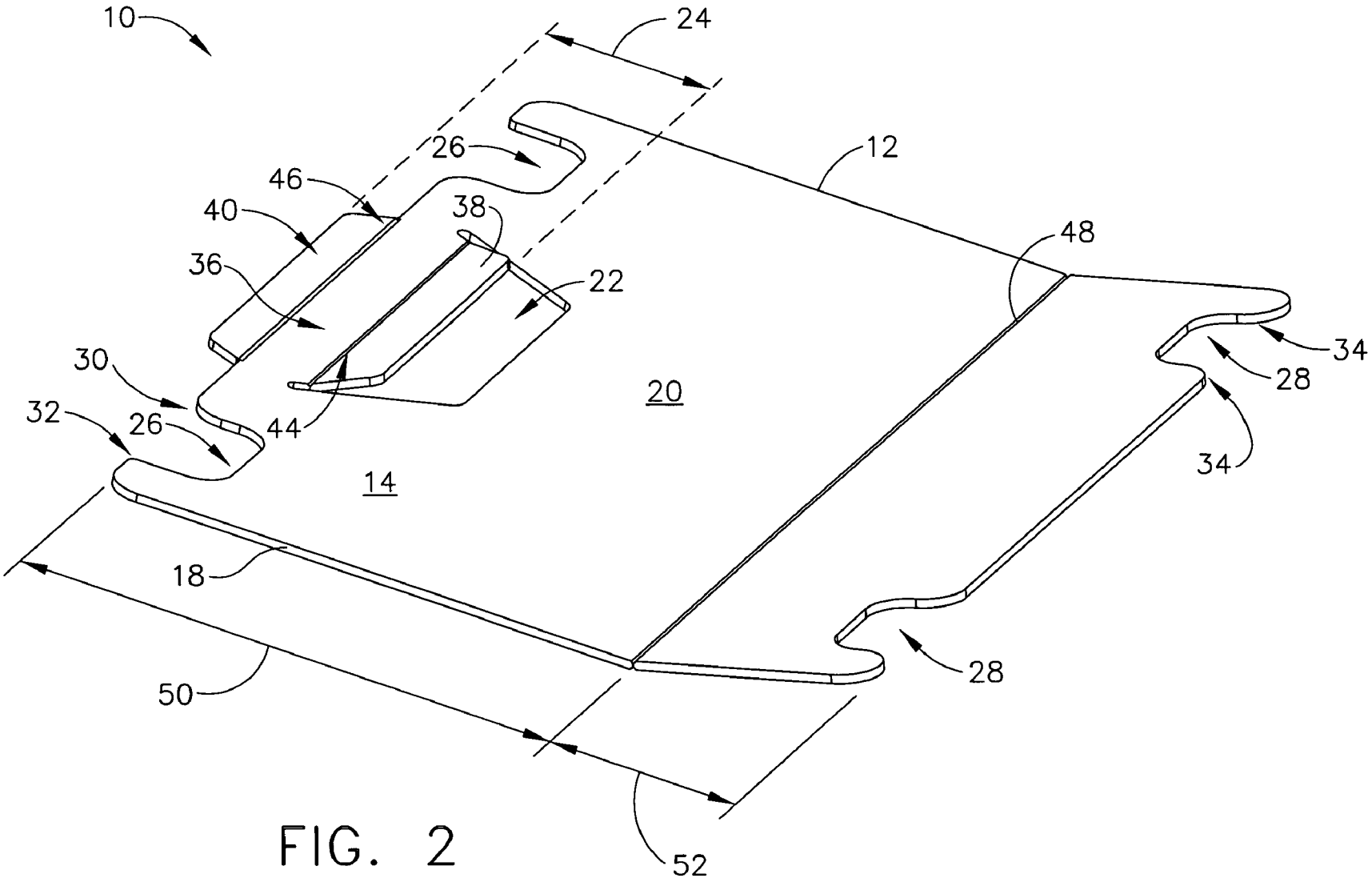
FIG. 2 is a perspective view of the container carrier shown in FIG. 1.

Referring now to the drawings, wherein like reference numerals designate corresponding or similar elements throughout the various drawings, an embodiment of a container carrier according to the present invention is shown in FIGS. 1 and 2 and generally designated at 10. The container carrier comprises a thin substantially planar flexible platform 12. The platform 12 has an upper surface 14, a lower surface 16 (which is not visible in FIG. 1), an outer perimeter 18, and an inner region 20. The inner region 20 of the platform 12 defines an opening 22 for receiving at least one of a user's fingers forming a handle portion 24.

The platform 12 is preferably formed from a synthetic polymer. Suitable synthetic polymers are those that are tear resistant, relatively rigid, flexible, capable of temporary deformation and relatively easy to perforate, including without limitation, polycarbonate, polyethylene (PET), high density polyethylene (HDPE), polypropylene, nylon polymers (i.e., polyamides) and the like, and blends thereof. Nevertheless, the container carrier 10 may be constructed from a wide variety of materials. It is understood that the scope of the present invention is not intended to be limited by the materials listed herein, but may be carried out using any materials that allow the construction and use of the described container carrier according to the present invention.

As shown in FIGS. 1 and 2, the outer perimeter 18 of the platform 12 has a pair of recesses 26, 28 on opposite sides of the container carrier 10. The recesses 26, 28 are generally U-shaped. Each of the recesses 26 which are proximal to the handle portion 24 are partially defined by an inner handle engaging tab 30 that is outwardly radiused while the outer handle engaging tab 32 is only slightly outwardly radiused. Each of the recesses 28 distal to the handle portion 24 are partially defined by handle engaging tabs 34 which are outwardly radiused.

The handle portion 22 of the container carrier 10 comprises a central strap 36 and inner and outer longitudinal flanges 38, 40 which extend from opposite sides of the strap 36. The opening 22 through the inner region 20 of the platform 12 is generally U-shaped. The left and right upper most portions 42 of this U-shaped opening 22 are outwardly radiused. These outwardly radiused portions 42 provide for curvature in the U-shaped opening 22 and help to distribute the forces exerted upon the handle portion 24 for preventing tearing or ripping at the outwardly radiused portions 42 during use of the container carrier 10. Preferably, the opening 22, the strap 36 and the inner flange are sized so that the opening 22 is wide enough to provide finger access to the opening 22.

The width of the inner flange 38 and the outer flange 40 are comparable to the width of the strap 36. The inner flange 38 is scored by a line 44 substantially parallel to the longitudinal axis of the strap and formed in the upper surface 14 of the platform 12. This inner flange score line 44 transverses the width of the inner flange 38. The inner flange score line 44 is formed at the boundary where the strap 36 and the inner flange 38 meet. The outer flange 40 is also scored by a line 46 substantially parallel to the longitudinal axis of the strap and formed in the upper surface 14 of the platform 12. Likewise, this outer flange score line 46 transverses the width of the outer flange 40. The inner flange score line 44 and the outer flange score line 46 function to impart rigidity to the respective inner flange 38 and outer flange 40. To achieve this purpose, for one embodiment of the present invention, only one score line is shown in the inner flange 38 and the outer flange 40; however, it should be understood and recognized by one of skill in the art that the number and location of the score lines may vary. For example, the score lines 44, 46 do not have to be parallel to one another or to the longitudinal axis of the strap 36 of the handle portion 24 as shown in FIGs. When a plurality of score lines are formed, two or more of the score lines may intersect. Moreover, the score lines can be formed in either the upper surface 14 or the lower surface 16 of the platform 12, or both.

A score line 48 transverses the entire width of the platform 12 at a position spaced between the sides of the platform 12 having recesses 26, 28. The score line 48 is formed in the upper surface 14 of the platform 12, is substantially parallel to the longitudinal axis of the strap 36, and divides the platform 12 into an upper portion 50 and a lower portion 52. Referring to FIG. 2, this score line 48 enables the lower portion 52 of the platform 12 to function as a hinge and to flex upwardly toward the upper portion 50 of the platform 12. FIG. 2 also shows how the inner flange 38 and outer flange 40 work in conjunction with the strap 36 to provide a generally concave U-shaped handle portion 24 to enable a user to comfortably carry two heavy filled containers 54, as will be described below.

Figure 3:
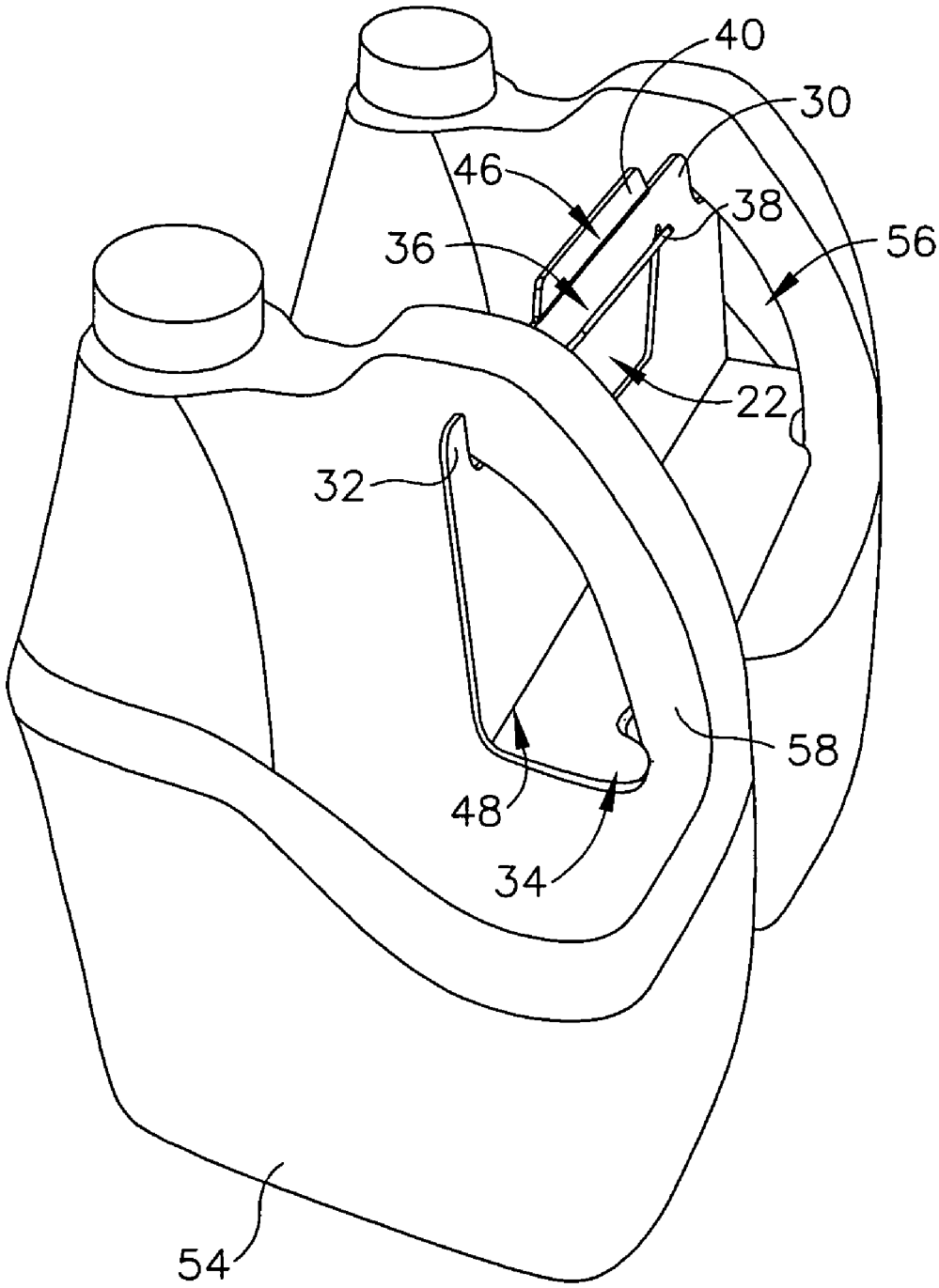
FIG. 3 is a perspective view of the container carrier shown in FIG. 1 mounted on two containers.
Figure 4:
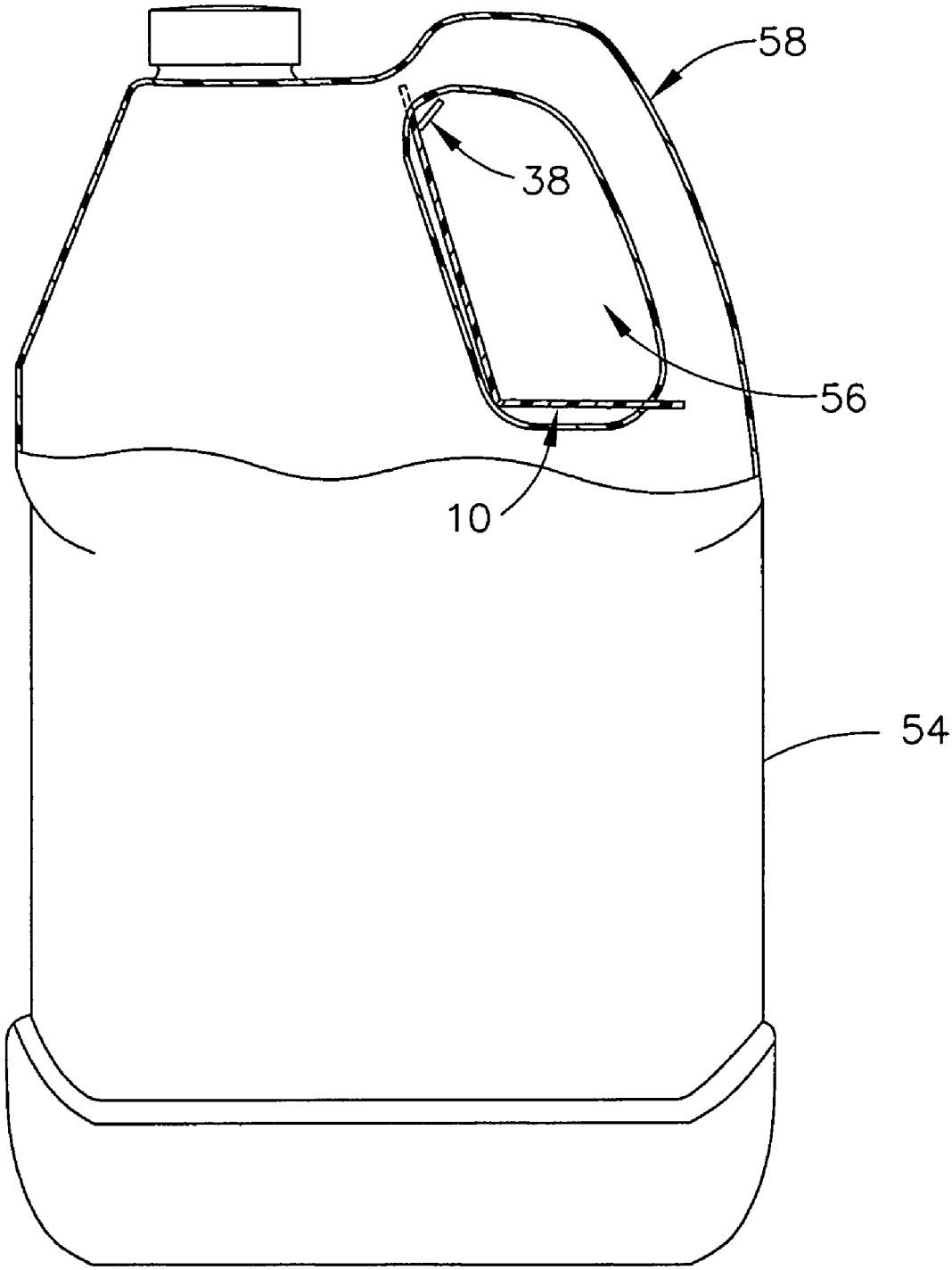
FIG. 4 is a cross-sectional view of the container carrier and the containers shown in FIG. 3.
Figure 5:
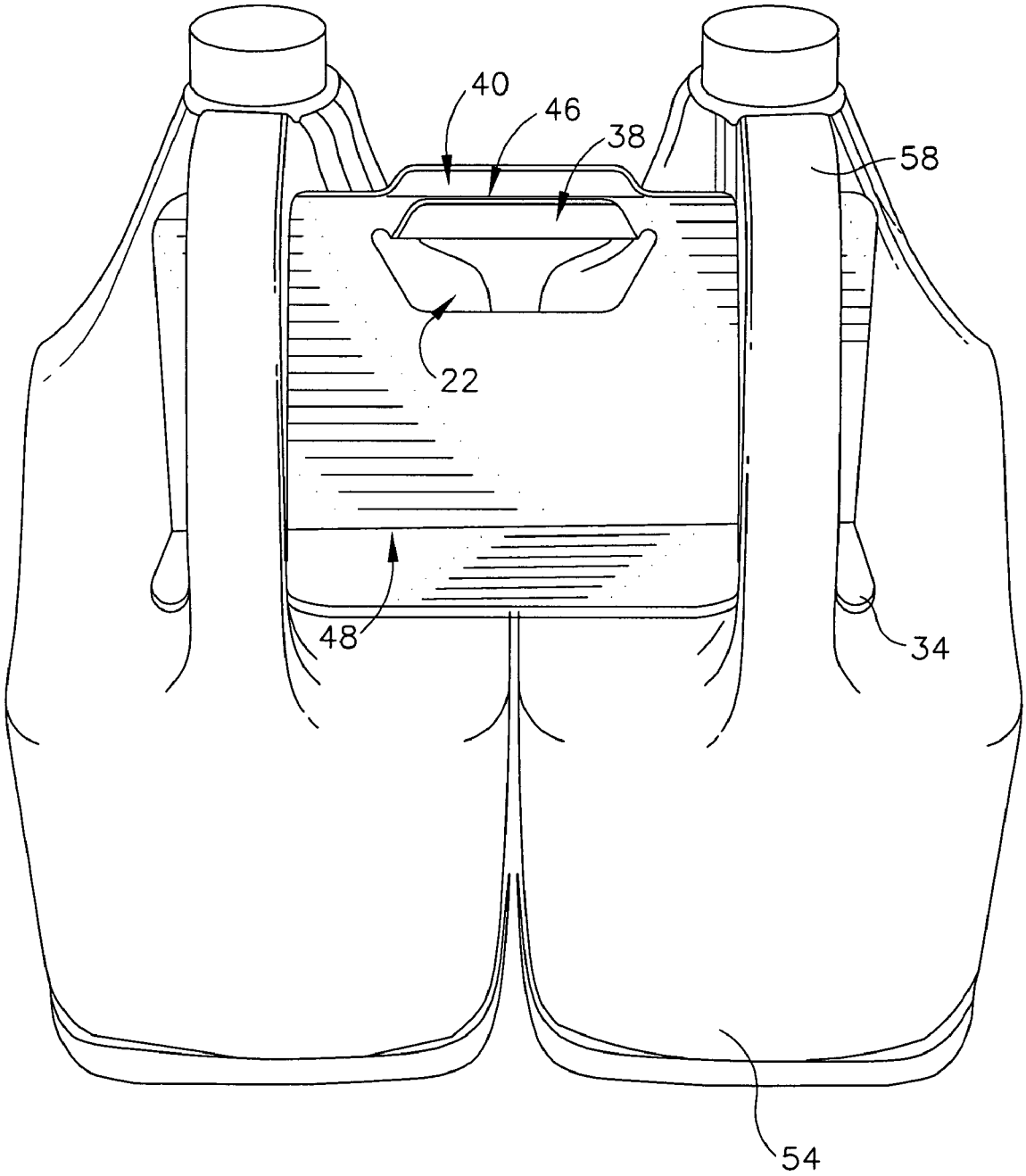
FIG. 5 is another perspective view of the container carrier and the containers shown in FIG. 3.
Figure 6:
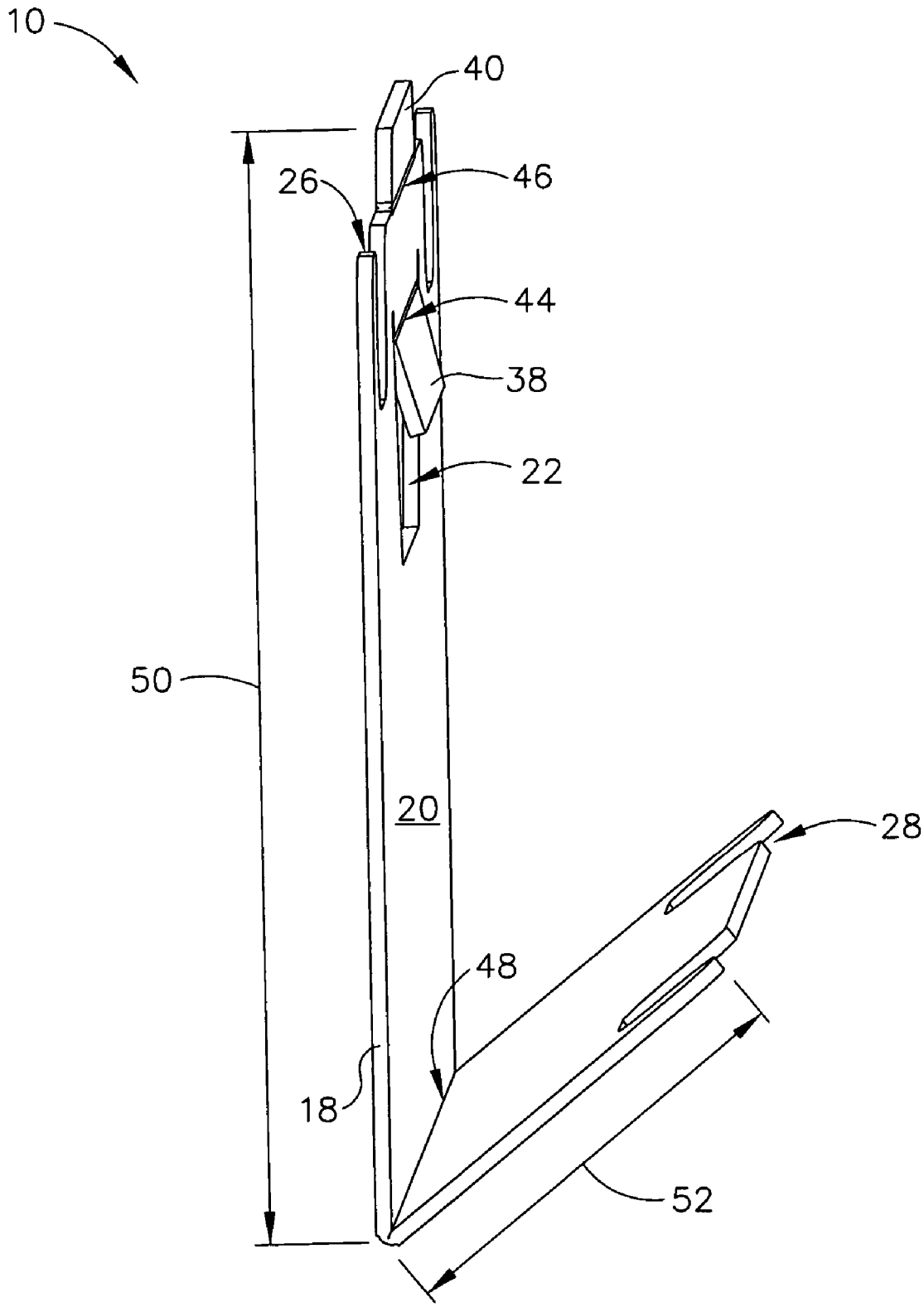
FIG. 6 is a side elevation view of the container carrier shown in FIG. 1.

Referring now to FIGS. 3-5, the container carrier 10 of the present invention is shown installed onto two containers 54. For installation, reference should now be made to FIG. 6, which shows the lower portion 52 of the platform 12 resiliently flexed upwardly toward the upper portion 50 of the platform 12. In this position, the profile of the container carrier 10 is reduced and easily inserted in the opening 56 defined by the handles 58 of the containers 54. The container carrier 10 is inserted into the handle openings 56 until the recesses 26 adjacent the handle portion 24 are aligned with the respective handles 58. The container carrier 10 is then moved upward relative to the handles 58 such that the handles 58 of the containers 54 are received in the recesses 26 adjacent to the handle portion 24. The combination of the inner handle engaging tab 30 and the outer handle engaging tab 32 in the recesses 26 adjacent to the handle portion 24 function so as to securely seat the carrier 10 against the handles 58. After the above seating has occurred, the lower portion of the platform 52 is then released and the handles 58 are received in the recesses 28 in the lower portion 52 as the platform 12 returns to a more planar configuration. The use of the outwardly radiused engaging tabs 32 allows the distal recesses 28 to more readily and easily engage the container handles 58 when the container carrier 10 is placed into use and under the weight of the containers 54. As seen in FIGS. 3-5, the recesses 26, 28 in the platform 12 seat against the handles 58 where the handles 58 join the containers 54. As a result of this seating operation, the container carrier 10 securely holds the two containers 54, and remains secure during normal handling and transport.

Once the container carrier 10 is installed onto the containers 54, the user may lift and transport the container carrier 10 and the secured containers 54 as a single package. As best seen in FIGS. 3 and 5, to use the container carrier 10, the user inserts his fingers from above the platform 12 through the opening 22. The user then curls his fingers around the strap 36 and the inner and outer flanges 38, 40 so that the flanges 38, 40, along with the strap 36, rest in the region beneath the finger pads of the hand, and then lifts the container carrier 10. As may be more fully appreciated in FIG. 2, the scores lines in the inner and outer flanges 44, 46 will enable the inner and outer flanges 38, 40, in conjunction with the strap 36, to assume a slightly parabolic shape. At this point, the weight of the container 54 is evenly distributed across the strap 36, and the inner and outer flanges 38, 40 which rest comfortably in the user's hand.

It should be noted that although the recesses 26, 28 in the above described embodiment of the present invention are shown as being opposite each other, an embodiment of the present invention could have recesses 26, 28 which are not opposite each other. The position of the recesses 26, 28 in the platform 12 will be dictated by the particular handle 58 of the container 54 to be transported by the carrier 10.

Figure 7:
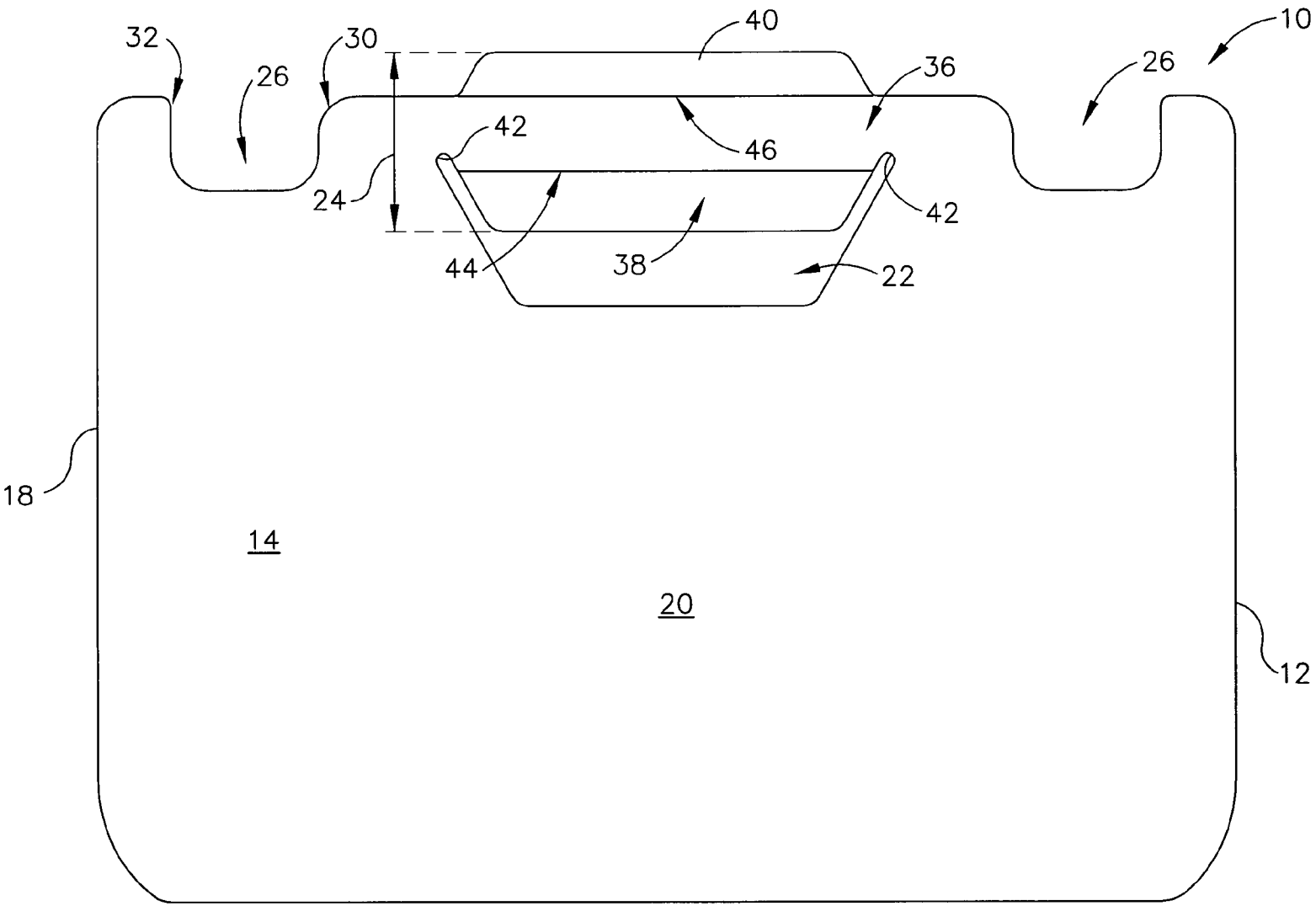
FIG. 7 is a top plan view of another embodiment of a container carrier according to the present invention.
Figure 8:
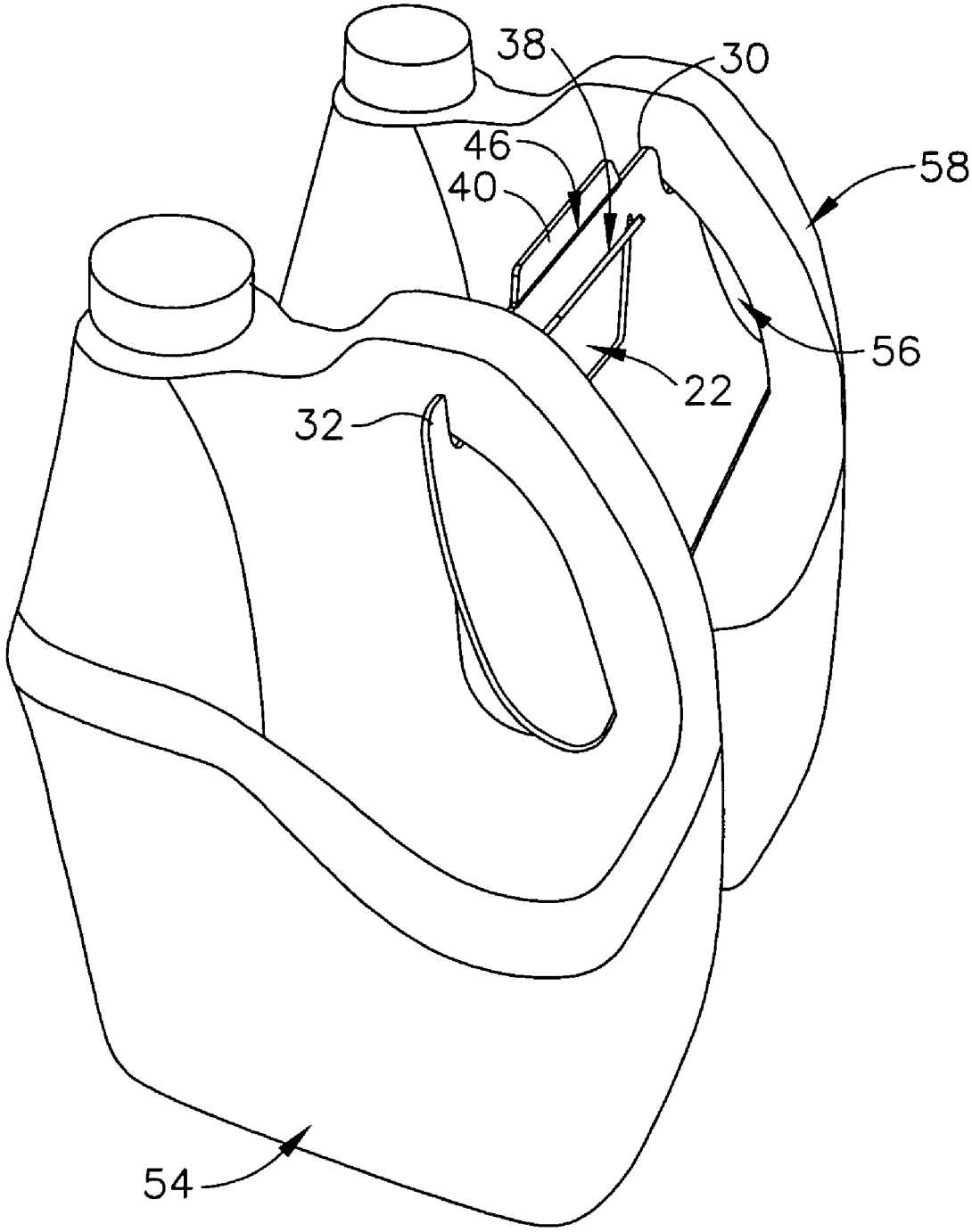
FIG. 8 is a perspective view of the container carrier shown in FIG. 7 mounted on two containers.

Another embodiment of the present invention is shown in FIGS. 7-8. In this embodiment, there is no platform score line nor are there any distal recess portions for receiving the handles of containers. In use, the container carrier 10 is sized such that, when the container carrier is secured in containers 54, the container carrier 10 will assume a generally parabolic shape as shown in FIG. 8 and securely seat itself within the handles 58 of the containers 54. In this embodiment, the proximal recess portions anchor the carrier because the handles of the containers are secured in the proximal recess portions when the carrier is inserted into the handle openings for seating as described above. With the container handles seated in the proximal recess portions, the weight of the containers is borne by the proximal recess portions, and thus allows for a fully functional carrier.

Yet another embodiment which is a variation on the above embodiment is possible. In this embodiment, there is no platform score line nor are there any proximal recess portions for receiving the handles of containers. Instead, there are only distal recess portions for receiving the handles of containers. In use, the container carrier 10 is sized such that, when the container carrier is secured in containers 54, the container carrier 10 will assume a generally parabolic shape as shown in FIG. 8 and securely seat itself within the handles 58 of the containers 54. In such an embodiment, the distal recess portions would anchor the carrier because the handles of the containers would have been secured in the distal recess portions when the carrier was inserted into the handle openings for seating as described above. The side of the platform opposite of the distal recess portions in which the handle portion is found would, as in the above embodiments, still be supporting the weight of the containers, and thus still allow for a fully functional carrier.

It is contemplated that, in one embodiment, the container carrier 10 of the present invention will carry containers with handles, such as the oil containers 54 shown in the FIGs. However, it is understood, without limitation, that jugs, spray bottles, anti-freeze containers and other types of containers or packages may be used in connection with the present invention. Also, it is understood, without limitation, that more than two containers may be transported with the handle that is described herein. In any such embodiment of the present invention, there would need to be an equivalent number of recesses in such a carrier. For example, an embodiment of the present invention for transporting four containers would have at least four recesses so as to secure the carrier to the handles of the containers. Preferably, the container carrier 10 carries an even number of containers such that the same number of recesses may be provided on opposite sides of the handle portion.

The container carrier 10 of the present invention can be manufactured by numerous methods known to those skilled in the art. In one embodiment of the present invention, the container carrier 10 may be manufactured utilizing a punch and die set to form the container carrier 10 from a substantially planar sheet of polymeric material. This method includes the steps of providing a sheet of polymeric material to a punch and die set; punching openings through the sheet to form the recesses 26, 28, the handle portion 24, the inner flange 38 and the outer flange 40; scoring the inner flange 38, the outer flange 40 and the lower portion of the platform 52; punching the sheet to define the outer perimeter 18 of the container carrier 10; and severing the container carrier 10 from the sheet of polymeric material. A first die is preferably shaped so that one stroke forms all of the openings in the inner region 20 of the platform 12. A lathe or other equivalent apparatus is used to score the substantially parallel lines transversely across the inner flange 38, outer flange 40 and lower portion of the platform 52. A second die is shaped so that one stroke forms the outer perimeter 18 of the container carrier 10 and severs the container carrier 10 from the sheet of polymeric material.

A steel rule die cutter could also be used for the manufacture of the container carrier 10 of the present invention. The punch and die set is preferred, however, since the punch and die set allows for smaller, more precise cuts to be made in the platform material in order to form the handle portion 24 according to the present invention. In particular, the use of a punch and die set allows for the openings 42 forming the handle portion 24 to be cut with outwardly radiused ends. As previously described herein, this feature aids in distributing the forces exerted upon the container carrier 10, and helps to prevent tearing at the ends of the openings 42.

Individual carriers 90 are arranged in a cartridge 114 of stacked carriers connected by a fusion bond between individual carriers. This arrangement facilitates shipment and loading of the carriers 90. The individual carriers 90 are readily sheared from the cartridge 114 for dispensing. The cartridge form 114 of the carriers 90 for use in the present invention, and methods of dispensing the carriers 90 from the cartridge 114, have been previously described in U.S. Pat. No. 4,662,974, which issued May 5, 1987; U.S. Pat. No. 4,811,861, which issued Mar. 14, 1989; U.S. Pat. No. 4,854,931, which issued Aug. 8, 1989; U.S. Pat. No. 4,946,536, which issued Aug. 7, 1990; U.S. Pat. No. 5,222,931, which issued Jun. 29, 1993; and U.S. Pat. No. 5,437,594, which issued Aug. 1, 1995, the contents of all of which are hereby incorporated by reference.

The container carrier 10 according to the present invention has many advantages, including, but not limited to, a flexible handle portion 24 comprising a strap 36 integrally connected to an upwardly movable inner flange 38 and outer flange 40 which allows the container carrier 10 to be securely and comfortably transported and used. The combination of the strap 36 and the inner flange 38 and outer flange 40 provides a large and comfortable area whereby the weight of the containers 54 are spread more evenly over the fingers of the user's hand. When the user lifts upwardly upon the handle portion 24, a larger opening 22 is created which allows the user to insert his fingers so that the strap 36, the inner flange 38 and outer flange 40 come to rest upon the fingertips of the user's hand, thereby providing the secure and comfortable container carrier 10 for transporting and moving containers 54. Further, because the container carrier 10 can be made of recyclable material, the container carrier 10 of the present invention can be recycled together with the container 54.

Although the present invention has been shown and described in considerable detail with respect to only a few exemplary embodiments thereof, it should be understood by those skilled in the art that we do not intend to limit the invention to the embodiments since various modifications, omissions and additions may be made to the disclosed embodiments without materially departing from the novel teachings and advantages of the invention, particularly in light of the foregoing teachings. For example, although the recesses are illustrated as generally U-shaped, it is understood that the recesses may be any shape necessary to accommodate a particular container to be packaged. Accordingly, we intend to cover all such modifications, omissions, additions and equivalents as may be included within the spirit and scope of the invention as defined by the following claims.

What is claimed is:

1. A carrier for use with containers including handles, the container carrier comprising:

a flexible platform having a perimeter, a longitudinal axis, and an opening, a portion of the platform at least partially defining the opening and adjacent the closest side of the perimeter of the platform forming a carrier handle including a strap, the strap located such that the longitudinal axis of the platform transverses the strap;

first and second recessed portions in the perimeter of the platform and located proximally to the carrier handle, the first and second recessed portions located on opposite sides of the longitudinal axis of the platform that transverses the strap, each first and second recessed portion receives and engages an upper extent of a respective container handle, and the platform is sized and configured such that a lower extent of each container handle is also engaged by the carrier; and third and fourth recessed portions are located distally to the carrier handle to engage the lower extents of the container handles;

wherein the opening is sized for receiving at least one of a user's fingers for lifting and transporting the containers.

2. A container carrier as recited in claim 1, wherein each of the first and second recessed portions is partially defined by an inner container handle engaging tab that is outwardly radiused and an outer handle engaging tab that is slightly outwardly radiused and wherein further each of the third and fourth recessed portions is partially defined by container handle engaging tabs which are outwardly radiused.

3. A container carrier as recited in claim 1, wherein the carrier handle further comprises an inner flange integral with the strap and extending inwardly of the strap for substantially the length of the strap.

4. A container carrier as recited in claim 3, wherein the inner flange has a transverse score line formed in a surface of the platform.

5. A container carrier as recited in claim 3, wherein the inner flange has a plurality of transverse score lines formed in a surface of the platform.

6. A container carrier as recited in claim 3, wherein the inner flange has a transverse score line formed in the upper surface and lower surface of the platform.

7. A container carrier as recited in claim 1, wherein the carrier handle further comprises an outer flange integral with the strap and extending outwardly of the strap for substantially the length of the strap.

8. A container carrier as recited in claim 7, wherein the outer flange has a transverse score line formed in a surface of the platform.

9. A container carrier as recited in claim 7, wherein the outer flange has a plurality of transverse score lines formed in a surface of the platform.

10. A container carrier as recited in claim 7, wherein the outer flange has a transverse score line formed in the upper surface and lower surface of the platform.

11. A container carrier as recited in claim 1, wherein the carrier handle further comprises an inner flange integral with the strap and extending inwardly of the strap for substantially the length of the strap and an outer flange integral with the strap and extending outwardly of the strap for substantially the length of the strap.

12. A container carrier as recited in claim 11, wherein the inner flange and outer flange both have a transverse score line formed in a surface of the platform.

13. A container carrier as recited in claim 11, wherein the inner flange and outer flange both have a plurality of transverse score lines formed in a surface of the platform.

14. A container carrier as recited in claim 11, wherein the inner flange and outer flange both have a transverse score line formed in the upper surface and lower surface of the platform.

15. A container carrier as recited in claim 1, wherein the platform is substantially planar.

16. A container carrier as recited in claim 1, wherein the carrier handle is substantially perpendicular to the longitudinal axis of the platform.

17. A container carrier as recited in claim 1, wherein the platform is formed from a polymeric material.

18. A container carrier as recited in claim 17, wherein the polymeric material is selected from the group consisting of polycarbonate, polyethylene (PET), high density polyethylene (HDPE), polypropylene, nylon polymer, and blends thereof.

19. A container carrier as recited in claim 1, wherein the ends of the opening proximal to the handle are outwardly radiused.

20. A container carrier as recited in claim 1, wherein a score line transverses the entire width of the platform at a position spaced between the sides of the platform having recessed portions.

21. A container carrier as recited in claim 1, wherein the first and second recessed portions are generally U-shaped.

* * * * *